US008100705B2

(12) United States Patent
Chen et al.

(10) Patent No.: US 8,100,705 B2
(45) Date of Patent: Jan. 24, 2012

(54) SAFETY DOOR FOR A ROTATABLE POWER SUPPLY SOCKET

(75) Inventors: Fu Hua Chen, Zhejiang (CN); Lidong Ni, Zhejiang (CN); Chongguang Zhang, Zhejiang (CN)

(73) Assignee: Wenzhou MTLC Electric Appliances Co., Ltd., Yueqing (CN)

( * ) Notice: Subject to any disclaimer, the term of this patent is extended or adjusted under 35 U.S.C. 154(b) by 0 days.

(21) Appl. No.: 12/699,796

(22) Filed: Feb. 3, 2010

(65) Prior Publication Data

US 2010/0317208 A1 Dec. 16, 2010

(30) Foreign Application Priority Data

Feb. 24, 2009 (CN) ..... 2009 1 0009201

(51) Int. Cl.
*H01R 13/44* (2006.01)

(52) U.S. Cl. ..... 439/137; 439/145

(58) Field of Classification Search ..... 439/137, 439/145

See application file for complete search history.

(56) References Cited

U.S. PATENT DOCUMENTS

| | | | | |
|---|---|---|---|---|
| 6,217,353 | B1 * | 4/2001 | Yu-Tse | 439/145 |
| 6,422,880 | B1 * | 7/2002 | Chiu | 439/137 |
| 7,312,963 | B1 * | 12/2007 | Radosavljevic et al. | 361/42 |
| 7,510,412 | B1 * | 3/2009 | Valentin | 439/145 |
| 7,556,513 | B2 * | 7/2009 | Ng et al. | 439/137 |
| 2009/0325410 | A1 * | 12/2009 | Huang et al. | 439/137 |
| 2010/0041259 | A1 * | 2/2010 | Ni | 439/137 |

* cited by examiner

*Primary Examiner* — Hien Vu
(74) *Attorney, Agent, or Firm* — Ziegler IP Law Group, LLC

(57) ABSTRACT

A safety door for use with a rotatable power supply socket having a mounting base with plugging holes therein. The safety door includes first, second and third sliding parts, and an elastic assembly. The safety door includes three rectangular plugging holes, a left-hand, middle and right-hand plugging hole, and two ground plugging holes, upper and lower. While sliding in a rail slot of the mounting base, the first sliding part can block the left-hand plugging hole while sliding along the left-right direction, the second sliding part can block the right-hand plugging hole while sliding along the left-right direction; the third sliding part can block or expose the middle plugging hole while sliding along the left-right direction. The elastic assembly includes a first elastic part for providing returning elastic force to the first sliding part and a second elastic part for providing returning elastic force to the second sliding part.

20 Claims, 3 Drawing Sheets

SAFETY DOOR FOR A ROTATABLE POWER SUPPLY SOCKET

BACKGROUND

1. Field

The aspects of the disclosed embodiments belong to the technical field of electric connectors and, particularly, relate to a safety door for a rotatable power supply socket.

2. Brief Description of Related Developments

At present, there is a type of three-hole power supply socket which is mounted on the wall, and comprises two rectangular plugging holes arranged in parallel with one another and a semicircular ground plugging hole, with the three plugging holes arranged in a triangle arrangement; once this power supply socket is mounted on the wall, the arrangement of the three plugging holes are fixed along with it, for example, with two rectangular plugging holes at the lower part and the ground plugging hole at the upper part; and due to the reasons for ensuring the circuit security, the three-hole plugs for fitting therein generally use cables of relatively large diameters, which are not easy to bend or with a very small bendable degree, leading to a preferred orientation for the use of such plugs, such that the plugs can be plugged conveniently in the defined direction of the metal plug pieces, while the plugging is inconvenient if the plug is plugged in the reversed direction. For example, most computer power lines are of large diameters and limited lengths, and it happens often that the length of a line is not enough or the three-plug arrangement is not consistent with the three-plugging hole arrangement, leading to inconvenience in its use.

SUMMARY

The disclosed embodiments provide a safety door for a rotatable power supply socket, into which a three-hole plug is allowed to be inserted either in a certain orientation or in an orientation rotated by 180 degrees.

The technical solution for achieving the object of the disclosed embodiments is as follows: a safety door for a rotatable power supply socket, comprising a mounting base provided with composite plugging holes; a first sliding part, a second sliding part and a third sliding part which are in mutual cooperation; and an elastic assembly provided on the mounting base; wherein said composite plugging holes comprise three rectangular plugging holes arranged at equal distance and in parallel with one another and two ground plugging holes acting as the ground lines, and said two ground plugging holes are located respectively at the upper side and the lower side of the rectangular plugging holes; the three rectangular plugging holes from left-hand to right are referred to as the left-hand plugging hole, the middle plugging hole and the right-hand plugging hole; the two ground plugging holes from top downwards are referred to as the upper grounded plugging hole and lower grounded plugging hole; said left-hand plugging hole, middle plugging hole and upper ground plugging hole constitute a first three-hole power supply socket; and said middle plugging hole, right-hand plugging hole and lower ground plugging hole constitute a second three-hole power supply socket;

said mounting base is provided with a rail slot for disposing said first sliding part, second sliding part and said third sliding part;

said first sliding part can slide reciprocally in said rail slot in the left-right direction, and the first sliding part can block or expose the left-hand plugging hole during its sliding movements;

said second sliding part can slide reciprocally in said rail slot in the left-right direction, and said second sliding part can block or expose the right-hand plugging hole during its sliding movements;

said third sliding part can slide reciprocally in the rail slot in the left-right direction, and said third sliding part can block or expose the middle plugging hole during its sliding movements;

said elastic assembly comprises two main elastic parts for providing returning elastic forces to the third sliding part, a first elastic part for providing a returning elastic force to the first sliding part and a second elastic part for providing a returning elastic force to the second sliding part; and wherein said two main elastic parts are located respectively at two sides of the third sliding part.

In the above technical solution, the left-hand end of said first sliding part is provided with a block part for blocking the left-hand plugging hole, the right-hand end is provided with a bearing part for bearing external forces; the bottom part of said bearing part is provided with a sliding groove; a limiting hole is provided between said block part and said bearing part; the right-hand end of said bearing part is provided with a slope surface or an arc face acting as the bearing surface; when unloaded, said bearing part is located just above said middle plugging hole and blocks the lower half of said middle plugging hole, and said block part is located just above said left-hand plugging hole and wholly blocks the left-hand plugging hole;

the left-hand end of said second sliding part is provided with a bearing part for bearing external forces, the right-hand end is provided with a block part for blocking the right-hand plugging hole; the bottom part of said bearing part is provided with a sliding groove; a limiting hole is provided between said block part and said bearing part; the left-hand end of said bearing part is provided with a slope surface or an arc face acting as the bearing surface; when unloaded, said bearing part is located just above said middle plugging hole and blocks the upper half of said middle plugging hole, and said block part is located just above said right-hand plugging hole and blocks the whole right-hand plugging hole;

the left-hand end of said third sliding part is provided with a left-hand bearing part for bearing external forces, the right-hand end thereof is provided with a right-hand bearing part for bearing external forces, the middle end is provided with a block part for blocking the middle plugging hole; between said left-hand bearing part and said block part and also between said right-hand bearing part and said block part are each arranged with a limiting hole; the left-hand end of said left-hand bearing part is provided with a slope surface or an arc face acting as the bearing surface, and the right-hand end of said right-hand bearing part is provided with a slope surface or an arc face acting as the bearing surface; and when unloaded, said block part is located just above said middle plugging hole and in the sliding groove at the bottom part of the bearing part of said first sliding part and the bearing part of said second sliding part, blocking the whole middle plugging hole.

In the above technical solution, said two main elastic parts are respectively left-hand main elastic part and right-hand main elastic part; wherein the left-hand main elastic part is arranged at the left-hand side of the third sliding part, with one end thereof abutting against the mounting base while the other end abuts against the left-hand end of the third sliding part; the right-hand main elastic part is arranged at the right-hand side of the third sliding part, with one end thereof abutting against the mounting base while the other end abuts against the right-hand end of the third sliding part; said first sliding part is located at the left-hand side of the first sliding part, with one end thereof abutting against the mounting base while the other end abuts against the left-hand end of the first sliding part; and said second sliding part is located at the right-hand side of the second sliding part, with one end thereof abutting against the mounting base while the other end abuts against the right-hand end of the second sliding part.

In the above technical solution, said two main elastic parts, the first elastic part and the second elastic part are all leaf springs; and said mounting base is provided with a positioning stud assembly for fixing the leaf springs.

In the above technical solution, the mounting base is provided with a left-hand limiting part for limiting the sliding distance of the first sliding part and a right-hand limiting part for limiting the sliding distance of the second sliding part; said left-hand limiting part is a boss projecting upwards from the right-hand margin of the left-hand plugging hole and is located in the limiting hole of said first sliding part; said right-hand limiting part is a boss projecting upwards from the left-hand margin of the right-hand plugging hole and is located in the limiting hole of said second sliding part.

In the above technical solution, the left-hand plugging hole can be exposed while said first sliding part is sliding towards the left; and the left-hand plugging hole is blocked when said first sliding part returns to its original position;

said second sliding part can slide reciprocally in the rail slot along the left-right direction, the right-hand plugging hole can be exposed while the second sliding part is sliding towards the right; and the right-hand plugging hole is blocked when said second sliding part returns to its original position;

said third sliding part can slide reciprocally in the rail slot along the left-right direction, the middle plugging hole can be exposed while said third sliding part is sliding either towards the left-hand or towards the right; and the middle plugging hole is blocked when said third sliding part returns to its original position.

In the above technical solution, said first sliding part and said second sliding part are identical both in structure and in size.

In the above technical solution, the basic shape of the ground plugging holes is a semicircle The disclosed embodiments have the following positive effects:

(1) By providing a safety door made of three mutually cooperating sliding parts and corresponding elastic parts for blocking the three rectangular plugging holes (i.e. the plugging holes for the electric connection), an external three-hole plug can either be plugged into the first electric socket, or be plugged into the second electric socket after having been rotated by 180 degrees.

(2) The unique structural design ensures that when a hard object, such as a nail, is plugged into a single rectangular plugging hole, the object will not be able to make contact with the power line through a plugging hole, therefore no electric shock will happen, so the safety of children is effectively guaranteed; and electric contact with the power lines can only be made if the left-hand plugging hole and the middle plugging hole are plugged into simultaneously, or the right-hand plugging hole and the middle plugging hole are plugged into simultaneously.

(3) The first sliding part and second sliding part are identical both in structure and in size, and are made from the same mold, thus reducing the production costs.

DETAILED DESCRIPTION OF THE DISCLOSED EMBODIMENTS

Figure 1:
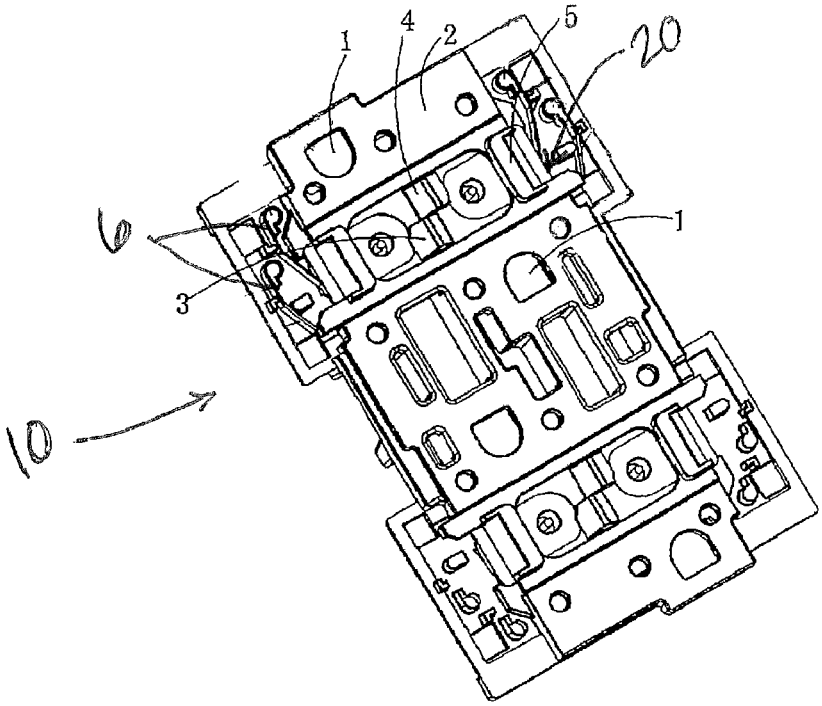
FIG. 1 is a perspective structural diagram of a rotatable power supply socket with a safety door in accordance with aspects of the disclosed embodiments.

The symbols shown in the drawings are: rotatable power supply socket 10, safety door 20, a left-hand rectangular plugging hole 111, a middle rectangular plugging hole 112, a right-hand rectangular plugging hole 113, an upper ground plugging hole 121, a lower ground plugging hole 122, a mounting base 2, a rail slot 21, a positioning stud assembly 22, a left-hand limiting part 23, a right-hand limiting part 24, a first sliding part 3, a blocking part 31, a bearing part 32, a bearing surface 321, a sliding groove 33, a limiting hole 34, a second sliding part 4, a bearing part 41, a bearing surface 411, a block part 42, a sliding groove 43, a limiting hole 44, a third sliding part 5, a left-hand bearing part 51, a bearing surface 511, a right-hand bearing part 52, a block part 53, a limiting hole 54, an elastic assembly 6, a main elastic part 61, a left-hand main elastic part 611, a right-hand main elastic part 612, a first elastic part 62, a second elastic part 63, a first power supply socket 100 and a second power supply socket 200.

Embodiment 1

Figure 2:
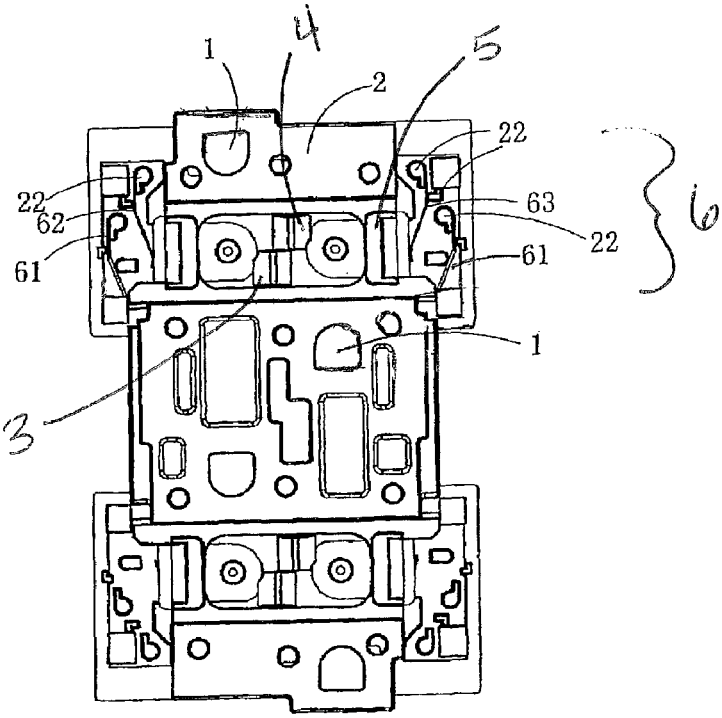
FIG. 2 is a schematic structural diagram observed in a front view of the safety door for a rotatable power supply socket as shown in FIG. 1.
Figure 3:
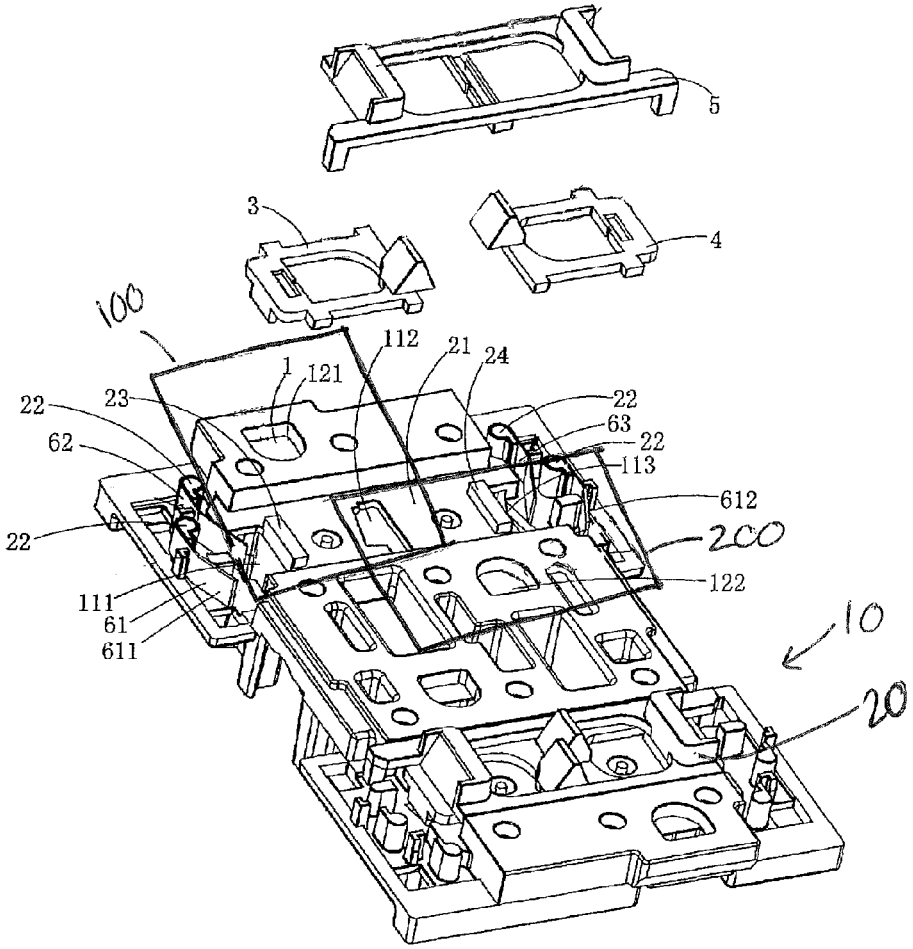
FIG. 3 is an exploded structural diagram of the safety door for a rotatable power supply socket as shown in FIG. 1.
Figure 4:
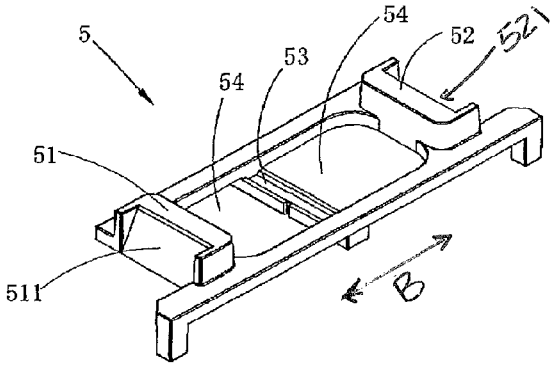
FIG. 4 is a perspective structural diagram of the third sliding part of the safety door for a rotatable power supply socket as shown in FIG. 1.
Figure 5:
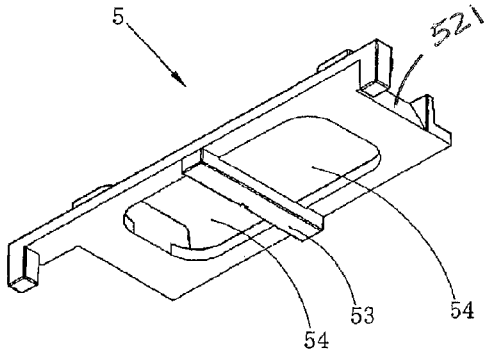
FIG. 5 is a perspective structural diagram of the third sliding part as shown in FIG. 4 in another angle of view.
Figure 6:
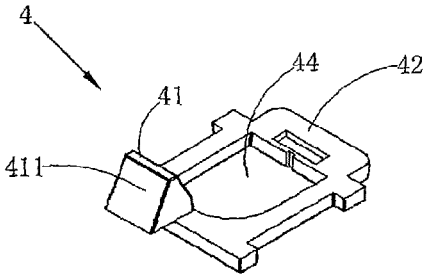
FIG. 6 is a perspective structural diagram of the second sliding part of the safety door for a rotatable power supply socket as shown in FIG. 4.
Figure 7:
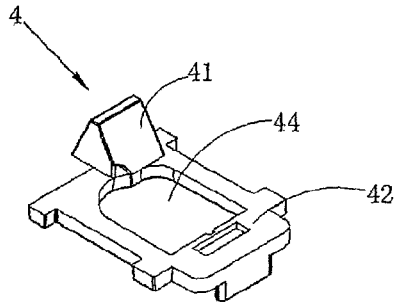
FIG. 7 is a perspective structural diagram of the second sliding part as shown in FIG. 6 in another angle of view.
Figure 8:
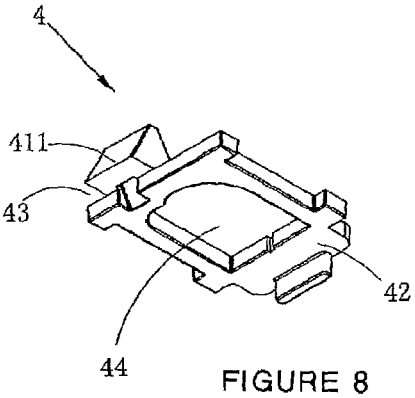
FIG. 8 is a perspective structural diagram of the second sliding part as shown in FIG. 7 in another angle of view.
Figure 9:
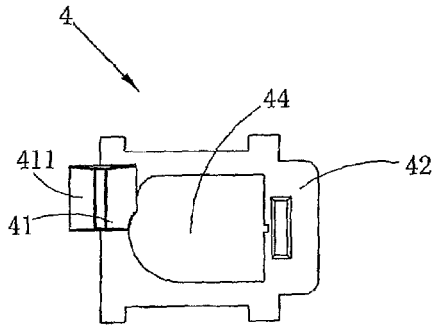
FIG. 9 is a structural diagram of the second sliding part as shown in FIG. 7 in a front view.
Figure 10:
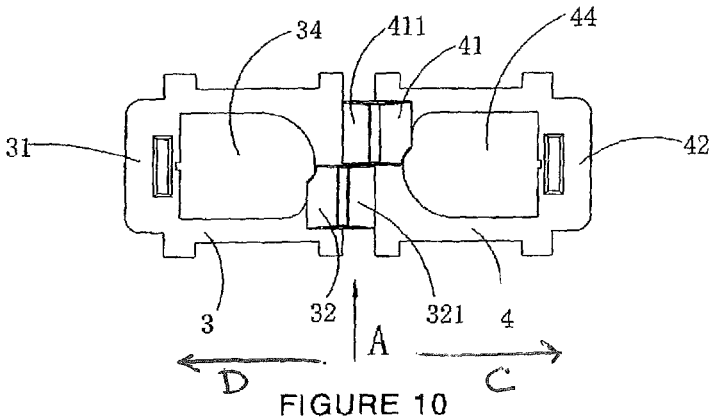
FIG. 10 is a structural diagram of the first sliding part combined with the second sliding part of the safety door for a rotatable power supply socket as shown in FIG. 1.
Figure 11:
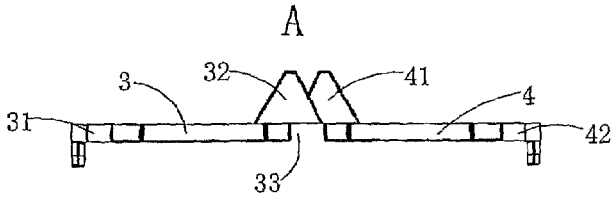
FIG. 11 is a structural diagram of FIG. 10 in direction A.

FIG. 1 to FIG. 11 illustrate a first embodiment, wherein FIG. 1 is a perspective structural diagram of the disclosed embodiments; FIG. 2 is a front view structural diagram of the safety door for a rotatable power supply socket as shown in FIG. 1; FIG. 3 is an exploded structural diagram of the safety door for a rotatable power supply socket as shown in FIG. 1; FIG. 4 is a perspective structural diagram of the third sliding part of the safety door for a rotatable power supply socket as shown in FIG. 1; FIG. 5 is a perspective structural diagram of the third sliding part as shown in FIG. 4 in another angle of view; FIG. 6 is a perspective structural diagram of the second sliding part of the safety door for a rotatable power supply socket as shown in FIG. 4; FIG. 7 is a perspective structural diagram of the second sliding part as shown in FIG. 6 in another angle of view; FIG. 8 is a perspective structural diagram of the second sliding part as shown in FIG. 7 in another angle of view; FIG. 9 is a structural diagram of the second sliding part as shown in FIG. 7 in a front view; FIG. 10 is a structural diagram of the first sliding part combined with the second sliding part of the safety door for a rotatable power supply socket as shown in FIG. 1; and FIG. 11 is a structural diagram of FIG. 10 in direction A.

A rotatable power supply socket 10 in accordance with aspects of the disclosed embodiments is illustrated in FIG. 1 In this embodiment, rotatable power supply socket 10 comprises a mounting base 2 provided with plugging holes 1, some of which are exposed, while others are covered by a safety door 20. Safety door 20 comprises a first sliding part 3, a second sliding part 4 and a third sliding part 5 which are in mutual cooperation, and an elastic assembly 6 provided on the mounting base 2.

FIG. 3 is an exploded view of the rotatable power supply socket 10 of FIG. 1, and illustrates the structure of rotatable power supply socket 10 when the sliding parts 3, 4, 5, of safety door 20 are removed. In this embodiment, all of plugging holes 1 are uncovered. Plugging holes 1 include three rectangular plugging holes 111, 112, 113 arranged at equal distance and in parallel with one another and two ground plugging holes 121, 122 acting as the grounding lines, and said two ground plugging holes 121, 122 are located respectively at the upper side and the lower side of the rectangular plugging holes 111, 112, 113. The basic shape of said ground plugging holes 12 is semicircular The three rectangular plugging holes from left to right are referred to in sequence as the left-hand plugging hole 111, the middle plugging hole 112 and the right-hand plugging hole 113; said two ground plugging holes from top downwards are referred to in sequence as the upper grounded plugging hole 121 and the lower grounded plugging hole 122. Together, left-hand plugging hole 111, middle plugging hole 112 and upper ground plugging hole 121 constitute a first three-hole power supply socket 100, middle plugging hole 112, together with the right-hand plugging hole 113 and the lower ground plugging hole 122 constitute a second three-hole power supply socket 200 that is rotated 180 degrees with respect to power supply socket 100.

Referring to FIG. 3, said mounting base 2 is provided with a rail slot 21 for disposing therein safety door 20, comprising said first sliding part 3, second sliding part 4 and third sliding part 5. First sliding part 3 can slide in the rail slot 21 to the left, as indicated by arrow D in FIG. 10, to expose the left-hand plugging hole 111. In FIG. 1, first sliding part 3 is blocking left-hand plugging hole 111. Second sliding part 4 can slide in the rail slot 21 to the right, as indicated by arrow C of FIG. 10, to expose the right-hand plugging hole 113 during its sliding movements. In FIG. 1, second sliding part 4 is blocking right-hand plugging hole 113. Third sliding part 5 can slide reciprocally in the rail slot 21 along the left-right direction as indicated by arrow B of FIG. 4, and said third sliding part 5 can block or expose the middle plugging hole 112 during its sliding movements.

Referring to FIG. 1 to FIG. 3, the elastic assembly 6 comprises two main elastic parts 61 for providing returning forces to the third sliding part 5, a first elastic part 62 for providing a returning force to the first sliding part 3 and a second elastic part 63 for providing a returning force to the second sliding part 4 Main elastic parts 61 are located at two sides of the third sliding part 5, as illustrated in FIG. 2.

Referring to FIG. 6 to FIG. 11, said first sliding part 3 and second sliding part 4 in the embodiment are identical both in structure and in size.

Referring to FIG. 10, the left-hand end of said first sliding part 3 is provided with a block part 31 for blocking the left-hand plugging hole 111, the right-hand end is provided with a bearing part 32 for bearing external forces; a limiting hole 34 is provided between said block part 31 and said bearing part 32; the right-hand end of said bearing part 32 is provided with a slope surface or an arc face acting as the bearing surface 321; when unloaded, the bearing part 32 is located just above said middle plugging hole 112 and blocks the lower half of said middle plugging hole 112, and said block part 31 is located just above said left-hand plugging hole 111 and blocks the whole left-hand plugging hole 111.

Referring to FIG. 6 to FIG. 9, the left-hand end of said second sliding part 4 is provided with a bearing part 41 for bearing external forces, the right-hand end is provided with a block part 42 for blocking the right-hand plugging hole 113; a limiting hole 44 is provided between said block part 42 and said bearing part 41; the left-hand end of said bearing part 41 is provided with a slope surface or an arc face acting as the bearing surface 411; when unloaded, said bearing part 41 is located just above said middle plugging hole 112 and blocks the upper half of said middle plugging hole 112, and said block part 42 is located just above said right-hand plugging hole 113 and blocks the whole right-hand plugging hole 113.

As illustrated in FIG. 11, when first 3 and second 4 sliding parts are placed adjacent to one another, the bottom part of bearing parts 32 and 41 create a sliding groove 31

Referring to FIG. 4 to FIG. 5, the left-hand end of the said third sliding part 5 is provided with a left-hand bearing part 51 for bearing external forces, the right-hand end is provided with a right-hand bearing part 52 for bearing external forces, the middle end is provided with a block part 53 for blocking the middle plugging hole 112; between said left-hand bearing part 51 and said block part 53 and also between said right-hand bearing part 52 and said block part 53 are each provided with a limiting hole 54; the left-hand end of said left-band bearing part 51 is provided with a slope surface or an arc face acting as the bearing surface 511, and the right-hand end of said right-hand bearing part 52 is provided with a slope surface or an arc face acting as the bearing surface 521; and when unloaded, said block part 53 is located just above said middle plugging hole 112 and in the sliding groove 33 at the bottom part of the bearing part 32 of said first sliding part 3 and the bearing part 41 of said second sliding part 4, blocking the whole middle plugging hole 112.

Referring to FIG. 2, said two main elastic parts 61 are arranged at the left-hand and right-hand sides of the third sliding part 5, with one end thereof being attached to the mounting base 2 by a positioning stud assembly 22 while the other end abuts against the left- or right-hand end of the third sliding part 5.

First elastic part 62 is arranged at the left-hand side of the first sliding part 3, with one end thereof secured to mounting base 2 by a positioning stud assembly 22, while the other end abuts against the left-hand end of the first sliding part 3; and said second elastic part 63 is arranged at the right-hand side of the second sliding part 4, with one end thereof secured to the mounting base 2 by a positioning stud assembly 22 while the other end abuts against the right-hand end of the second sliding part 4.

Referring to FIG. 3, said mounting base 2 is provided with a left-hand limiting part 23 for limiting the sliding distance of the first sliding part 3 and a right-hand limiting part 24 for limiting the sliding distance of the second sliding part 4; said left-hand limiting part 23 is a boss projecting upwards from the right-hand margin of the left-hand plugging hole 111 and is located in the limiting hole 34 of said first sliding part 3; said right-hand limiting part 24 is a boss projecting upwards from the left-hand margin of the right-hand plugging hole 113 and is located in the limiting hole 44 of said second sliding part 4.

In this embodiment, said two main elastic parts 61, the first elastic part 62 and the second elastic part 63 are all leaf springs; said mounting base 2 is provided with a positioning stud assembly 22 for fixing the leaf springs.

In this embodiment, the left-hand plugging hole 111 can be exposed while said first sliding part 3 is sliding towards the left; and the left-hand plugging hole 111 is blocked when said first sliding part 3 returns to its original position;

said second sliding part 4 can slide reciprocally in the rail slot 21 along the left-right direction, the right-hand plugging hole 113 can be exposed while said second sliding part 4 is sliding towards the right; and the right-hand plugging hole 113 is blocked when said second sliding part 4 returns to its original position;

said third sliding part 5 can slide reciprocally in the rail slot 21 along the left-right direction, the middle plugging hole 112 can be exposed while said third sliding part 5 is sliding either towards the left-hand or towards the right; and the middle plugging hole 112 is blocked when said third sliding part 5 returns to its original position.

In the practical use of this embodiment, when an external three-hole plug is simultaneously plugged into the left-hand plugging hole 111, the middle plugging hole 112 and the upper ground plugging hole 121, a rectangular plugging piece of the three-hole plug corresponding to the left-hand plugging hole 111 presses against the left-hand bearing surface 511 of the third sliding part, so that the third sliding part 5 slides rightwards and exposes the middle plugging hole 112; at the same time, another rectangular plugging piece of the three-hole plug corresponding to the middle plugging hole 112 presses against the bearing surface 321 of the first sliding part 3 and the bearing surface 411 of the second sliding part 4 simultaneously, so that the first sliding part 3 slides leftwards and the second sliding part 4 slides rightwards, such that the block part 31 of the first sliding part no longer blocks the left-hand plugging hole 111; by then, the three-hole plug can be smoothly plugged into the first power supply socket 100 of the mounting base according to the aspects of the disclosed embodiments;

Furthermore, if the three-hole plug is rotated by 180 degrees, it can be plugged into a second power supply socket 200 consisting of the right-hand plugging hole 113, the middle plugging hole 112 and the lower ground plugging hole 122, a rectangular plugging piece of the three-hole plug corresponding to the right-hand plugging hole 111 presses against the right-hand bearing surface 521 of the third sliding part 5, so that the third sliding part 3 slides leftwards and exposes the middle plugging hole 112; at the same time, a rectangular plugging piece of the three-hole plug corresponding to the middle plugging hole 112 presses against the bearing surface 321 of the first sliding part 3 and the bearing surface 411 of the second sliding part 4 simultaneously, so that the first sliding part 3 slides leftwards and the second sliding part 4 slides rightwards, such that the block part 42 of the second sliding part 4 no longer blocks the right-hand plugging hole 113; at this time, the three-hole plug can be smoothly plugged into the second power supply socket hole 200 of the mounting base 2 according to the aspects of the disclosed embodiments.

This embodiment has good safety properties, for example, if a single nail is plugged into any one of the left-hand plugging hole, the right-hand plugging hole and the middle plugging hole, although the nail presses against the bearing surface of a corresponding sliding part and drives this sliding part to slide, the sliding part blocking the plugging hole does not move, therefore the nail cannot get through the plugging hole and make contact with the power supply, therefore no electric shock will happen.

This embodiment has the following advantages:

(1) In this embodiment, by providing a safety door 20 made of three mutually cooperating sliding parts 3, 4, 5 and corresponding elastic parts 61, 62, 63 for blocking the three rectangular plugging holes 111, 112, 113 (i.e. the plugging holes for the electric connection), an external three-hole plug can either be plugged into the first electric socket 100, or be plugged into the second electric socket 200 after having been rotated by 180 degrees.

(2) The unique structural design ensures that when a hard object, such as a nail, is plugged into a single rectangular plugging hole, the object will not be able to make contact with the power line through a plugging hole, therefore no electric shock will happen, so the safety of children is effectively guaranteed; and electric contact with the power lines can only be made if the left-hand plugging hole and the middle plugging hole are plugged into simultaneously, or the right-hand plugging hole and the middle plugging hole are plugged into simultaneously.

(3) In the embodiment, said first sliding part 3 and second sliding part 4 are identical both in structure and in size, and are made from the same mold, thus reducing the production costs.

It is clear that the above embodiment is only an example for illustrating clearly the aspects of the disclosed embodiments, but not a limitation to the implementation thereof. Various changes or alternations can be made on the basis of the above description by one skilled in the art. It is neither necessary nor possible to exhaust all the possible embodiments. Nevertheless, the obvious changes or alternations derived from those belonging to the spirit of the disclosed embodiments are still in the protective scope of the present invention.

What is claimed is:

1. A safety door for a power supply socket, the socket having a mounting base and right-hand, left-hand, and middle rectangular plugging holes arranged at equal distance and in parallel with one another, the safety door comprising:

a first sliding part, a second sliding part, and a third sliding part slidably mounted on the mounting base;

wherein the first sliding part is configured to slide reciprocally in a leftward direction to expose or block the left-hand rectangular plugging hole;

wherein the second sliding part is configured to slide reciprocally in a rightward direction to expose the right-hand rectangular plugging hole;

wherein the third sliding part is configured to block the middle rectangular plugging hole and slide reciprocally in a rightward or leftward direction to expose the middle rectangular plugging hole; and an elastic assembly comprising:

two main elastic parts located at two sides of the third sliding part for providing returning elastic forces to the third sliding part;

a first elastic part for providing returning elastic force to the first sliding part; and a second elastic part for providing returning elastic force to the second sliding part.

2. The safety door according to claim 1, wherein the first sliding part further comprises:

a first block part provided on a left end of the first sliding part configured to block the left-hand rectangular plugging hole;

a first bearing part provided on a right end of the first sliding part configured to bear external forces, the first bearing part being provided with a slope surface or an arc face as a first bearing surface;

a first limiting hole provided between the first block part and the first bearing part;

wherein, when the safety door is unloaded, the first bearing part is located just above the middle rectangular plugging hole and blocks a lower half of the middle rectangular plugging hole and the first block part is located just above the left-hand rectangular plugging hole and wholly blocks the left-hand rectangular plugging hole.

3. The safety door according to claim 2, wherein the second sliding part further comprises:

a second block part provided on a right end of the second sliding part for blocking the right-hand rectangular plugging hole;

a second bearing part provided on a left end of the second sliding part for bearing external forces, the second bearing part being provided with a slope surface or an arc face as a second bearing surface;

a second limiting hole provided between the second block part and the second bearing part;

wherein, when the safety door is unloaded, the second bearing part is located just above the middle rectangular plugging hole and blocks a lower half of the middle rectangular plugging hole and the second block part is located just above the right-hand rectangular plugging hole and wholly blocks the right-hand rectangular plugging hole; and wherein, when the safety door is unloaded, the first bearing part and the second bearing part rest in contact with one another to form a sliding groove on an underside of the first and second sliding parts.

4. The safety door according to claim 3, wherein the third sliding part further comprises:

a third bearing part provided on a left end of the third sliding part for bearing external forces, the third bearing part being provided with a slope surface or an arc face as a third bearing surface;

a fourth bearing part provided on a right end of the third sliding part for bearing external forces, the fourth bearing part being provided with a slope surface or an arc face as a fourth bearing surface;

a third block part provided in a middle portion of the third sliding part for blocking the middle rectangular plugging hole;

a third limiting hole provided between the third bearing part and the third block part;

a fourth limiting hole provided between the third block part and the fourth bearing part;

wherein, when the safety door is unloaded, the third block part is located just above the middle rectangular plugging hole and rests in the sliding groove on the underside of the first and second sliding parts, wholly blocking the middle plugging hole.

5. The safety door according to claim 1, wherein the two main elastic parts further comprise:

a left-hand main elastic part having first and second ends, wherein the first end is fixed to the mounting base by a first positioning stud assembly and the second end abuts against a left end of the third sliding part; and a right-hand main elastic part having first and second ends, wherein the first end is fixed to the mounting base by a second positioning stud assembly and the second end abuts against a left end of the third sliding part.

6. The safety door according to claim 1, wherein a first end of the first elastic part is fixed to the mounting base by a third positioning stud assembly and a second end of the first elastic assembly abuts against a left end of the first sliding part.

7. The safety door according to claim 1, wherein a first end of the second elastic part is fixed to the mounting base by a fourth positioning stud assembly and a second end of the second elastic assembly abuts against a right end of the second sliding part.

8. The safety door according to claim 1, wherein the two main elastic parts, the first elastic part and the second elastic part are all leaf springs.

9. The safety door according to claim 1, further comprising:

a left-hand limiting part provided on the mounting base for limiting a leftward sliding distance of the first sliding part;

a right-hand limiting part provided on the mounting base for limiting a rightward sliding distance of the second sliding part;

wherein the left-hand limiting part is a boss projecting upwards from a right-hand margin of the left-hand rectangular plugging hole and is located in the first limiting hole of the first sliding part;

wherein the right-hand limiting part is a boss projecting upwards from a left-hand margin of the right-hand rectangular plugging hole and is located in the second limiting hole of the second sliding part.

10. The safety door according to claim 1, wherein the left-hand rectangular plugging hole is exposed when the first sliding part is moved from an original position in a leftward direction and is blocked when the first sliding part returns to its original position.

11. The safety door according to claim 1, wherein the right-hand rectangular plugging hold is exposed when the second sliding part is moved from an original position in a rightward direction and is blocked when the second sliding part returns to its original position.

12. The safety door according to claim 1, wherein the middle plugging hole is exposed when the third sliding part is moved from an original position in either a rightward or leftward direction and is blocked when the third sliding part returns to its original position.

13. The safety door according to claim 1, wherein the first and second sliding parts are identical both in structure and in size.

14. The safety door according to claim 1, wherein the first and second sliding parts are slidably mounted in a rail slot on a face of the mounting base of the rotatable power supply socket.

15. A safety door for an electrical socket comprising:

a mounting base including a left, right and middle plug opening;

a rail slot member disposed in said mounting base;

a first sliding part disposed in said rail slot member biased in an unloaded state to block the left plug opening and configured to slide reciprocally to unblock the left plug opening in a loaded state;

a second sliding part disposed in the rail slot member biased in an unloaded state to block the right plug opening and configured to slide reciprocally to unblock the right plug opening in a loaded state;

a third sliding part disposed in the rail slot member over the first and second sliding part and configured to block the middle plug opening in an unloaded state and unblock the middle plug opening in a loaded state;

a first elastic member disposed in the mounting base configured to bias the first sliding part;

a second elastic member disposed in the mounting base configured to bias the second sliding part;

a pair of third elastic members disposed in the mounting base on each side of the third sliding part and configured to bias the third sliding part the first sliding member comprising a first blocking part on one end and a first bearing part on another end, the first blocking part configured to block the left plug opening and the first bearing part configured to block a lower half of the middle plug opening;

the second sliding member comprising a second blocking part on one end and a second bearing part on another end, the second blocking part configured to block the right plug opening and the second bearing part configured to block an upper half of the middle plug opening;

wherein when the first bearing part and the second bearing part are adjacent to each other, a sliding groove is formed along a bottom surface the third sliding member comprising a left end bearing part and a right end bearing part and a blocking part between the left end bearing part and the right end bearing part, the blocking part being received in the sliding groove along the bottom surface of the adjacent first and second bearing parts to block the middle plug opening.

16. The safety cover of claim 15, further comprising a first ground plug opening in an upper portion of the mounting base and a second ground plug in a lower portion of the mounting base, the first ground plug opening forming a first electrical socket with the left and middle plug openings, and the second ground plug forming a second electrical socket with the middle and right plug openings, wherein an orientation of the first electrical socket and second electrical socket on the mounting base are rotated 180 degrees relative to each other.

17. The safety cover of claim 15 wherein the first bearing part comprises a sloped first bearing surface and the second bearing part comprises a sloped second bearing surface.

18. A method of operating a safety door for an electrical socket comprising a mounting base including a left, right and middle plug opening; a rail slot member disposed in said mounting base; a first sliding part disposed in said rail slot member biased in an unloaded state to block the left plug opening and configured to slide reciprocally to unblock the left plug opening in a loaded state; a second sliding part disposed in the rail slot member biased in an unloaded state to block the right plug opening and configured to slide reciprocally to unblock the right plug opening in a loaded state; a third sliding part disposed in the rail slot member over the first and second sliding part and configured to block the middle plug opening in an unloaded state and unblock the middle plug opening in a loaded state; a first elastic member disposed in the mounting base configured to bias the first sliding part; a second elastic member disposed in the mounting base configured to bias the second sliding part; a pair of third elastic members disposed in the mounting base on each side of the third sliding part and configured to bias the third sliding part; the first sliding member comprising a first blocking part on one end and a first bearing part on another end, the first blocking part configured to block the left plug opening and the first bearing part configured to block a lower half of the middle plug opening; the second sliding member comprising a second blocking part on one end and a second bearing part on another end, the second blocking part configured to block the right plug opening and the second bearing part configured to block an upper half of the middle plug opening; wherein when the first bearing part and the second bearing part are adjacent to each other, a sliding groove is formed along a bottom surface; the third sliding part comprising a left end bearing part and a right end bearing part and a blocking part between the left end bearing part and the right end bearing part, the blocking part being received in the sliding groove along the bottom surface of the adjacent first and second bearing parts to block the middle plug opening;

the method comprising:

exposing both the left plug opening and the middle plug opening only when a left plug connector and a right plug connecter are simultaneously inserted into the left plug opening and the middle plug opening, respectively, wherein insertion of the left plug connector causes a pressing on the left hand bearing part of the third sliding member to force the third sliding member to the right to expose the middle plug opening and the insertion of the right plug connector causes a simultaneous pressing on each of the first bearing part of the first sliding member and the second bearing surface of the second sliding member to expose the left plug opening; and exposing both the right plug opening and the middle plug opening only when a left plug connector and a right plug connecter are simultaneously inserted into the right plug opening and the middle plug opening, respectively, wherein insertion of the right plug connector causes a pressing on the right hand bearing part of the third sliding member to force the third sliding member to the left to expose the middle plug opening and the insertion of the left plug connector causes a simultaneous pressing on each of the first bearing part of the first sliding member and the second bearing surface of the second sliding member to expose the right plug opening.

19. The method according to claim 18, comprising exposing the left plug opening only when the first sliding part is moved from an original position in a leftward direction and blocking the left plug opening when the first sliding part returns to its original position; and exposing the right plug opening only when the second sliding part is moved from an original position in a rightward direction and blocking the right plug opening when the second sliding part returns to its original position.

20. The method to claim 18, comprising exposing the middle plug opening only when the third sliding part is moved from an original position in either a rightward or leftward direction and blocking the middle plug opening when the third sliding part returns to its original position.

* * * * *